US005653665A

United States Patent [19]

Neeley

[11] Patent Number: 5,653,665

[45] Date of Patent: Aug. 5, 1997

[54] APPARATUS TO PROVIDE RELIEF FOR BACK PAIN

[76] Inventor: Michael Joseph Neeley, 2039 Rose Hill, Carrollton, Tex. 75007

[21] Appl. No.: 518,641

[22] Filed: Aug. 24, 1995

[51] Int. Cl.[6] ..... A63B 21/02

[52] U.S. Cl. ..... 482/106; 482/123; 482/125

[58] Field of Search ..... 482/93, 106, 130, 482/125, 121, 122, 123

[56] References Cited

U.S. PATENT DOCUMENTS

| | | | |
|---|---|---|---|
| 3,068,001 | 12/1962 | Portman . | |
| 3,068,003 | 12/1962 | Portman . | |
| 3,117,781 | 1/1964 | Vargo . | |
| 3,119,614 | 1/1964 | Berry . | |
| 3,498,609 | 3/1970 | Lukens . | |
| 3,521,881 | 7/1970 | Schaevitz . | |
| 3,672,361 | 6/1972 | Fourneron . | |
| 3,843,119 | 10/1974 | Davis . | |
| 4,076,237 | 2/1978 | Dussia . | |
| 4,093,211 | 6/1978 | Hughes et al. . | |
| 4,304,402 | 12/1981 | Ripp | 482/125 |
| 4,517,966 | 5/1985 | von Othegraven . | |
| 4,722,523 | 2/1988 | Yang . | |
| 4,779,867 | 10/1988 | Hinds . | |
| 5,042,800 | 8/1991 | Walter . | |
| 5,125,649 | 6/1992 | Fuller . | |
| 5,154,685 | 10/1992 | Chen . | |
| 5,156,580 | 10/1992 | Holland et al. . | |
| 5,186,701 | 2/1993 | Wilkinson . | |
| 5,224,924 | 7/1993 | Urso . | |
| 5,263,916 | 11/1993 | Bobich . | |
| 5,336,139 | 8/1994 | Miller . | |

FOREIGN PATENT DOCUMENTS

| | | | |
|---|---|---|---|
| 0007290 | of 1899 | United Kingdom | 482/106 |

*Primary Examiner*—Lynne A. Reichard
*Attorney, Agent, or Firm*—Renee' Michelle Larson

[57] ABSTRACT

According to the present invention, at least one adjustable resilient elastic cable interconnects a generally flat lower elongated rigid member and an upper elongated rigid member. The resilient elastic cable is attached to the lower elongated rigid member by at least one retention structure and is attached to the upper elongated rigid member by at least one connection member. Use of the back exercising apparatus in conjunction with selected exercises subjects the user's spine to vertical compression and, if desired, rotation, thereby placing traction on the spine. One or more masses may be optionally attached to the upper elongated rigid member to further increase the compression of the spine. Following termination of exercise, decompression of the user's spine yields relief of back pain.

11 Claims, 5 Drawing Sheets

APPARATUS TO PROVIDE RELIEF FOR BACK PAIN

BACKGROUND OF THE INVENTION

The present invention relates to a compact exercise apparatus and method for providing relief for back pain, and more specifically to an apparatus and method which enables a user to exercise specific muscles along the spinal column using compression and rotation in order to obtain relief from back pain.

By some estimates, Americans spend more than $16 billion per year in their quest for relief from back pain. At any given time, approximately 31 million Americans, or about one in eight people, suffer from back pain. According to the Liberty Mutual Insurance Company, the largest single payer of workers' compensation claims in the United States, approximately $1 million are paid every working day to cover claims by injured workers. Back pain is one of the most common, most expensive, and most litigious forms of on-the-job injuries. The National Council on Compensation Insurance reports that the cost to treat the average back strain or sprain is nearly $6,000 and the average cost to treat a herniated disc is nearly $23,500.

The group of back muscles thought to be the most probable source of muscular spasms and pain is the erector spinae group. This group consists of the spinalis, longissimus, and iliocostalis muscles which run the entire length of the back. Their points of insertion originate at individual vertebrae and ribs at the base of the neck and terminate at the end of the spine.

The muscles of the body are paired in their action. For example a biceps and a triceps, or an abductor and an adductor, work in tandem together. The abductor muscle pulls the forearm in while the adductor muscle allows the forearm to lengthen. Muscle pairing also exists in the muscles of the back. When the abductor is overworked it becomes inflamed and foreshortened. If the abductor is allowed to remain in this state, pain will result. It is only when a painful muscle is returned to its proper resting length, thereby allowing it to rest, that pain is alleviated.

Back pain in the muscles is commonly caused by an improper relationship between muscles of the back where there is typically an overworked, or agonistic, muscle and an underworked, or antagonistic, muscle. Over time, the fatigued, agonistic muscle becomes foreshortened and thus shorter than its normal or resting length. Foreshortening of the agonistic muscle correspondingly causes the antagonistic muscle to lengthen beyond its normal or resting length. This agonistic/antagonistic muscle pairing accounts for much of the back pain commonly experienced today.

Another common cause of back pain is the ruptured intervertebral disc. The intervertebral disc is a section of cartilage that acts as a cushion and a space for the individual vertebral bones. These discs are held in place by the outer ring of connective tissue and muscle called the annulus fibrosis. When the annulus fibrosis becomes weak and tears, the result is a ruptured intervertebral disc.

Many exercises performed in the gym are designed to strengthen and tone the body, but do not address the causes of back pain. Exercises that are typically performed with commonly available exercise devices are done to strengthen the extremities of the body (the arms and legs), the stomach, and the chest. Very few exercises or exercise devices address the erector spinae group or other deep muscles of the back. In addition to this, exercises or exercise devices commonly in use do not adequately exercise intervertebral discs of the spine.

A series of exercises designed to apply a mild traction force to the lower spinal region of the body is often prescribed by orthopedic surgeons to remedy back pain. These exercises, which typically involve rotation of the knees toward the chest region, succeed in applying a moderate amount of traction to the lower spinal region, but are limited in their effectiveness. This therapy for back pain primarily strengthens the sore muscles of the back and is based on the assumption that the muscles are sore because they are weak and must be strengthened in order to relieve pain. This approach fails to recognize that back pain is caused by an unbalanced relationship between an antagonistic muscle and an agonistic muscle of the erector spinae group. One apparatus utilizing this technique is disclosed in U.S. Pat. No. 4,076,237.

Other currently available exercise devices also do not properly exercise muscles closely associated with intervertebral discs of the back. Rather, currently available exercise devices are generally limited to general exercise of an individual's arms, legs and stomach and do not isolate paired muscles of the back or intervertebrae discs for exercise. Thus, there is an unmet need in the art to be able to strengthen the underworked muscles of an antagonistic/agonistic muscle pairing in order to return these muscles to their proper working length, thereby allowing sore overworked muscles to relax and back pain to be relieved.

SUMMARY OF THE INVENTION

It is an object of the invention to strengthen the muscles of an antagonistic/agonistic muscle pairing in order to relieve back pain.

Therefore, according to the present invention, a back exercising apparatus used in conjunction with suitable exercise provides vertical compression and, if desired, rotation of a users spine. Using the back exercising apparatus of the present invention to exercise addresses an unbalanced relationship between antagonistic/agonistic muscle pairings of the spine. Following termination of exercise, the spine decompresses, thereby relieving back pain and pressure on pinched nerves.

The back exercising apparatus of the present invention has at least one adjustable resilient elastic cable which interconnects a generally flat lower elongated rigid member and an upper elongated rigid member. The resilient elastic cable is attached to the lower elongated rigid member by at least one retention structure and is attached to the upper elongated rigid member by at least one connection member. One or more masses may be optionally attached to the upper elongated rigid member to further increase resistance during exercise.

BRIEF DESCRIPTION OF THE DRAWINGS

The novel features believed characteristic of the invention are set forth in the claims. The invention itself, however, as well as a preferred mode of use, and further objects and advantages thereof, will best be understood by reference to the following detailed description of an illustrative embodiment when read in conjunction with the accompanying drawing, wherein:

DESCRIPTION OF THE INVENTION

Using the present invention, it is possible to achieve relief of back pain even in individuals who experience chronic back pain or have had surgery which has failed to relieve back pain. The present invention utilizes a new concept in pain relief. This new concept, called "Remote Site Therapy" (RST), provides relief for lower back pain by isolating and exercising remote sites of the upper, middle, and lower back and, in so doing, putting traction on the lower spine. The advantages and benefits of the present invention include pain relief, improved posture, better sleep, increased stamina, feeling of well being, and increased energy.

Unlike current therapy for back pain which assumes that back soreness is due to a weak muscle, the remote site theory recognizes that an area is painful because it is overworked. Thus, the present invention recognizes that back pain is caused by an imbalance of a paired muscle group, i.e. longissimus muscles of the spine. When an imbalance of a paired muscle group exists, the overworked muscle of the pair causes the vertebrae of the spine to which the muscles are attached to move out of position and pinch a nerve that exits the spine. The present invention returns the paired muscle group to an equilibrium position, moving the displaced vertebra off the pinched nerve, thereby providing quick relief of back pain. In addition to this, RST has the effect of putting traction on painful areas of the lower back, separating the vertebrae and relieving pressure on pinched nerves.

The specific muscles that are exercised are the deep muscles of the back. Antagonistic muscles of the erector spinae group, including the multifidus, the longissimus thoracis, the semispinalis, and the rotatores muscles may each be exercised. The multifidus muscles cross 1 to 4 vertebrae each and are the deepest muscles of the back. The longisimus thoracis muscles attach the vertebrae with the ribs up and down the spinal column. The semispinalis and the rotatores are responsible for rotating the spinal column.

Figure 1:
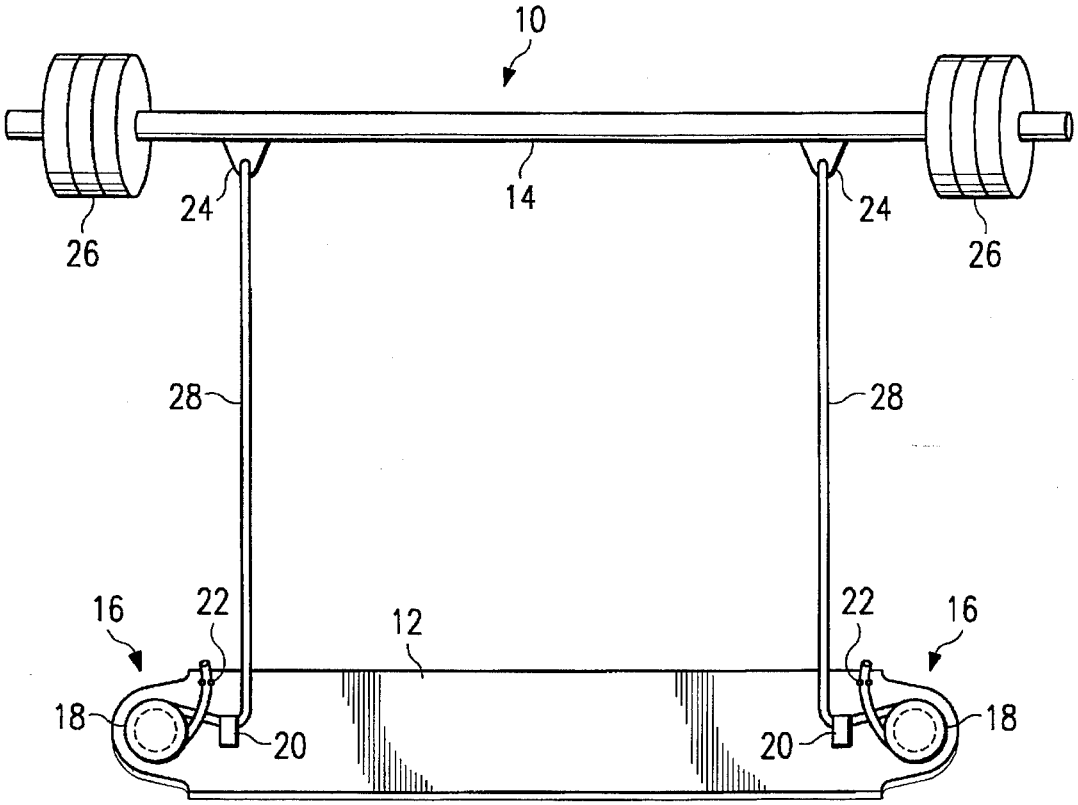
FIG. 1 is a perspective view of a back exercising apparatus, according to a first preferred embodiment of the present invention.

Referring to FIG. 1, a perspective view of back exercising apparatus 10 is shown. The elements of back exercising apparatus 10 include a generally flat lower elongated rigid member 12, an upper elongated rigid member 14, a pair of windlass retention structures 16 each having a spool 18, a guide member 20 and a retention member 22, a connection member 24, a mass 26, and a pair of adjustable resilient elastic members 28. The generally flat lower elongated rigid member 12 is attached to the upper elongated rigid member 14 by the pair of adjustable resilient elastic members 28 which may be rubber bands, bungee cords, elastic cords, elastic bands, elastic cables or any other structure which may be characterized as an adjustable resilient elastic member. In construction of the preferred embodiment, a length of three feet (3 ft.) for the lower elongated rigid member 12, the upper elongated rigid member 14, the adjustable resilient elastic members 28, and a diameter of one and one-half inches (1½ in.) for the upper elongated rigid member 14 has been found to be satisfactory. The resilient elastic members 28 may be easily adjusted in length one foot in either direction, shorter or longer, through use of the windlass retention structures 16. These dimensions may be changed as desired without departing from the spirit and scope of the invention.

Figure 1A:
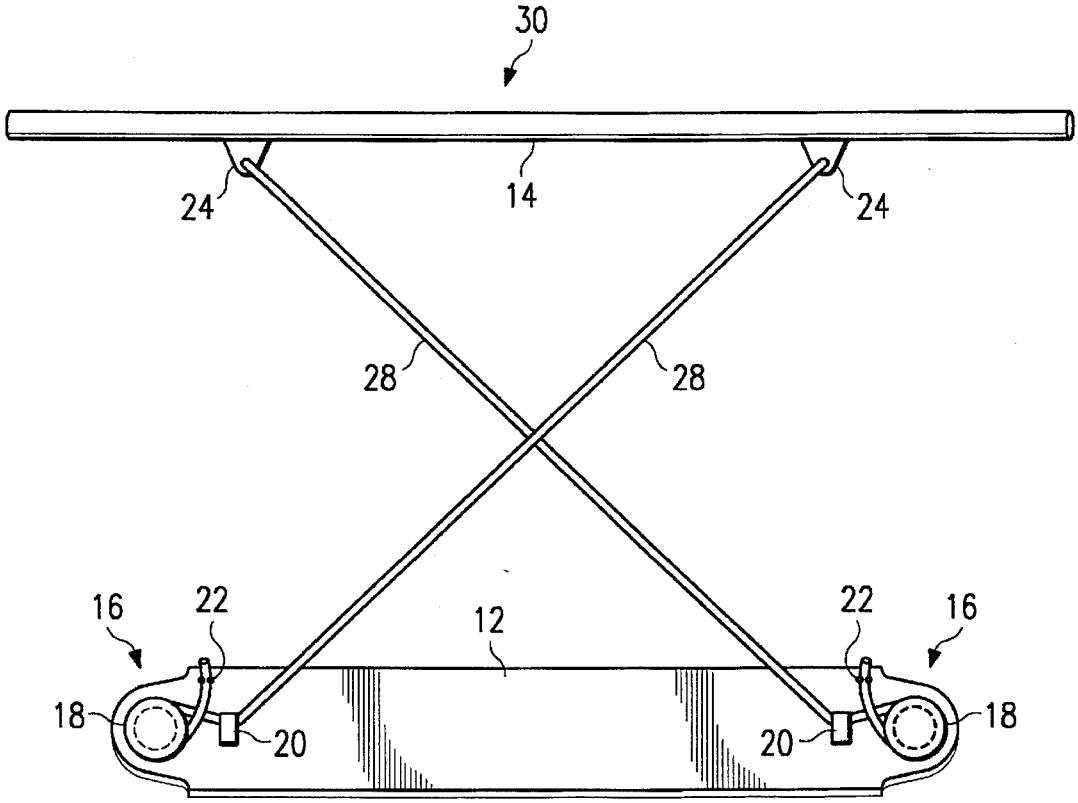
FIG. 1*a* is a perspective view of a back exercising apparatus, according to a second preferred embodiment of the present invention.

In the first preferred embodiment of FIG. 1, adjustable resilient elastic members 28 are generally attached equidistant from both ends of the upper elongated rigid member 14 and the lower elongated rigid member 12 more than shoulder-width apart, approximately eight (8) inches, to allow for proper tension of the muscles of the back; this positioning of adjustable resilient elastic members 28 greater than shoulder-width apart is necessary to exercise certain muscles of the back. Thus, adjustable resilient elastic members 28 are parallel in relation to each other, and if the lower elongated rigid member 12 and the upper elongated rigid member 14 were pulled apart in preparation for exercise, back exercising apparatus 10 would resemble a roman numeral II. Additionally, the pair of adjustable resilient elastic members 28 may connect the lower elongated rigid member 12 to the upper elongated rigid member 14 in a criss-cross fashion as shown in the back exercising apparatus 30 of FIG. 1*a*; the second preferred embodiment of FIG. 1*a* provides more vertical compression of the spine using a criss-cross connection than the parallel connection of FIG. 1.

It is important to note, however, that any number of elastic members 28, from one to more than two, may be used to connect the lower elongated rigid member 12 to the upper elongated rigid member 14 without departing from the spirit and scope of the invention. For instance, a single elastic member 28 may be used to connect the lower elongated rigid member 12 to the upper elongated rigid member 14, or three or more elastic members 28 may connect rigid member 12 to rigid member 14.

Figure 2:
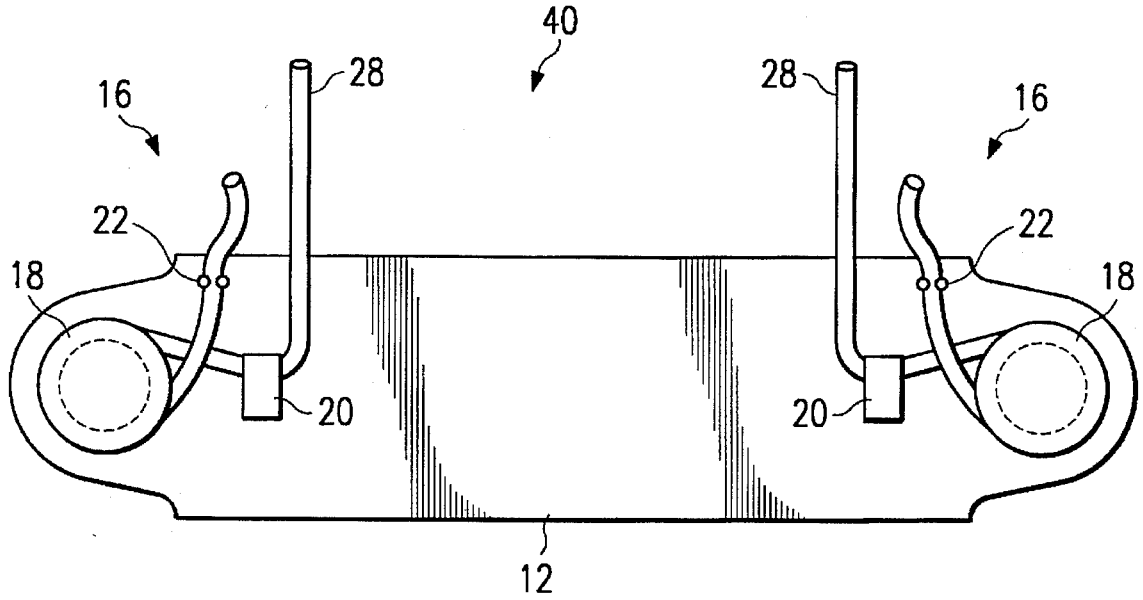
FIG. 2 is a perspective view of a windlass retention structure, according to the present invention.
Figure 3:
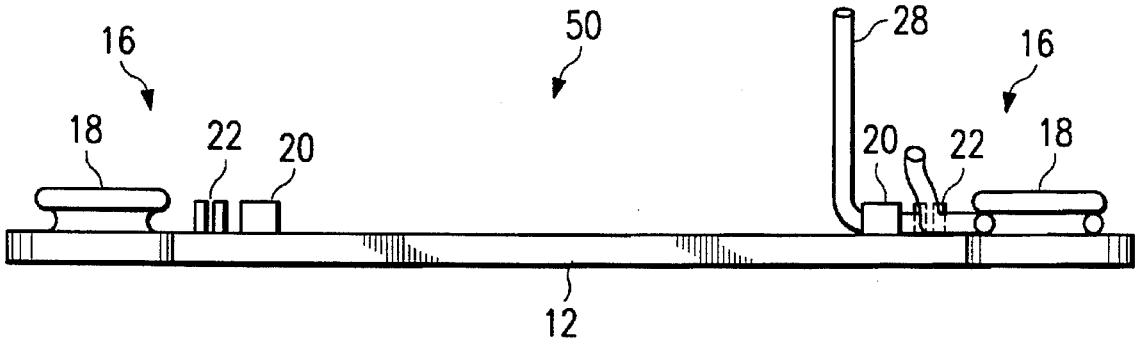
FIG. 3 is a cross-sectional view of the windlass retention structure of FIG. 2, according to the present invention.

The adjustable resilient elastic members 28 are attached to the lower elongated rigid member 12 by a pair of windlass retention structures 16, shown in perspective view 40 of FIG. 2 and in cross-sectional view 50 of FIG. 3. Windlass retention structures 16 allow for fast and easy adjustment and retention of adjustable resilient elastic members 28. One of the windlass retention structures 16 is connected to the left end of the lower elongated rigid member 12 while the other windlass retention structure is connected to the right end of the lower elongated rigid member 12. Each windlass retention structure 16 has a spool 18, a guide member 20 and a retention member 22 and is similar to a windlass structure often used on a sailboat or other nautical vehicle.

Windlass retention structure 16 provides for both the retention and adjustment of adjustable resilient elastic member 28. Adjustable resilient elastic member 28 passes through guide member 20, around spool 18 and is then secured by retention member 22 as shown in FIG. 2. Retention member 22 has two nubs or protuberances arranged far enough apart to receive adjustable resilient elastic member 28 but close enough together to secure and thus frictionally retain adjustable resilient elastic member 28. Adjustable resilient elastic member 28 may be adjusted by either wrapping more or less of it about spool 18 and securing it with retention member 22. While windlass retention structures 16 are used to attach adjustable resilient elastic member 28 to lower elongated rigid member 12, one skilled in the art will recognize that windless retention structures 16 may be used to attach adjustable resilient elastic member 28 to the upper elongated rigid member 14 in place of connection members 24 as well. The use of windlass retention structures 16 is but one type of retention structure that could be employed to connect adjustable resilient elastic members 28 to lower elongated rigid member 12. Velcro, knots, and loops are examples of other retention structures that could be used.

Referring again to FIG. 1, adjustable resilient elastic members 28 are attached to upper elongated rigid member 14 through the pair of connection members 24. Each connection member 24 is a triangular member with a hole through which elastic member 28 may pass and be secured, with a knot, velcro, or loop, for instance. Connection members 24 are not meant to be limited to a triangular member with a hole through it, and one skilled in the art will recognize that there are many ways to attach elastic members 28 to upper elongated rigid member 14.

Compression of the spine is accomplished by elastic resilient members 28. When the user pulls apart rigid members 12 and 14, the elastic force exerted by elastic members 28 acts as a downward compression force on the spine. The elasticity, or stiffness, of the elastic members 28 determines the compression force which will be exerted on the spine. The greater the elasticity of elastic members 28, the greater the compression force exerted on the spine. Similarly, the compression force exerted by elastic members 28 having a given elasticity on the spine may be increased by shortening the length of elastic members 28 in their unstretched state. Conversely, the compression force exerted by elastic members 28 may be decreased by lengthening the length of elastic members 28 in their unstretched state. Thus while a mass 26 is attached to each end of the upper elongated rigid member 14 in FIG. 1, these masses 26 are not necessary to effectuate compression on the spine of the user or to exercise the spinal musculature.

The pair of masses 26 attached to each end of the upper elongated rigid member 14 serves to further increase the compression of the spine achieved through elastic members 28 alone. Masses 26 may be any type of mass and are not limited to gym weights or dumbbells. Masses 26 need not be large in order to provide the desired traction of the spine and may be as small as zero to thirty pounds (0–30 lb.) to obtain the desired pain relief. The combination of elastic members 28 and light masses 26 yields a greater resistance or compression on the spine than the use of elastic members 28 only can provide. For instance, use of a small mass 26 in the range of 0 to 30 pounds can yield a much larger effective compression force on the spine of approximately 50 to 130 pounds. Thus, the addition of masses 26 to upper elongated rigid member 14 can greatly increase vertical compression of the spine and provide greater resistance to associated muscles.

In utilizing the present invention, there are a number of exercises which may be performed using the back exercising apparatus of FIGS. 1–3. Each exercise may be accordingly adapted to exercise the upper, middle and lower portions of the back. Generally, the user, in a standing position, places the generally flat lower elongated rigid member 12 under the feet. The upper elongated rigid member 14 is grasped by the user inside the connection structures 24 and is held at either waist level to provide minimum compression of the spine or is raised as desired to provide maximum compression of the spine. As previously discussed, the greatest compression of the spine is obtained when the upper elongated rigid member 14 is raised over the head of the user and masses 26 are attached to the upper elongated rigid member 14. The user, as an option, may exercise additional muscles of the upper, middle, and lower back by rotating the spinal column and then performing the desired exercise. Rotational of the spine allows the user to exercise more muscles than is possible using just vertical compression or conventional weight lifting.

Figure 4A:
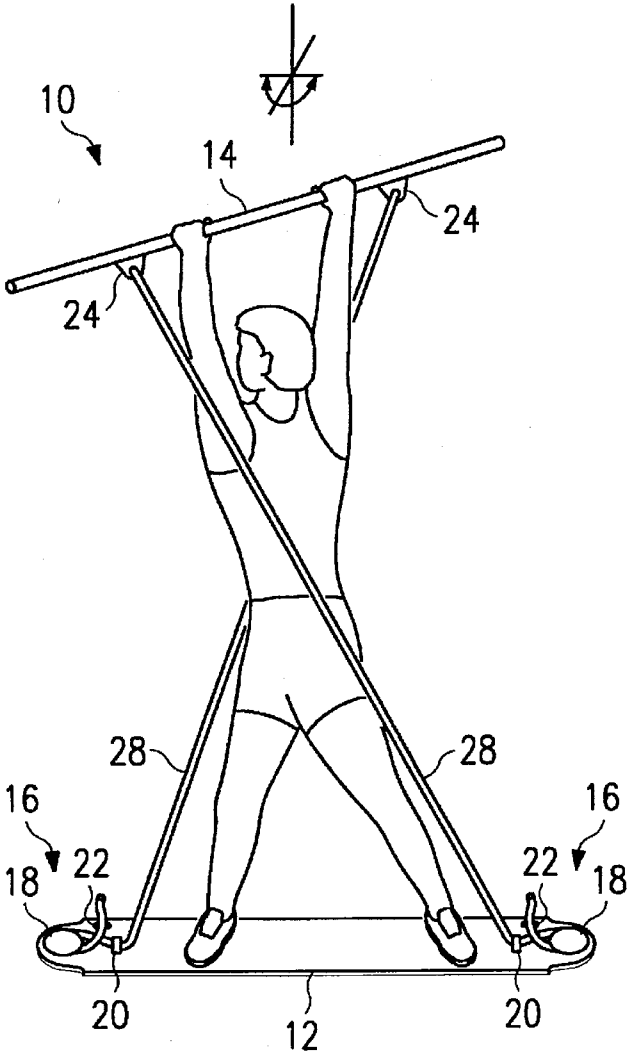
FIG. 4*a* illustrates a military press exercise with rotational compression, using the back exercising apparatus of the present invention.
Figure 4:
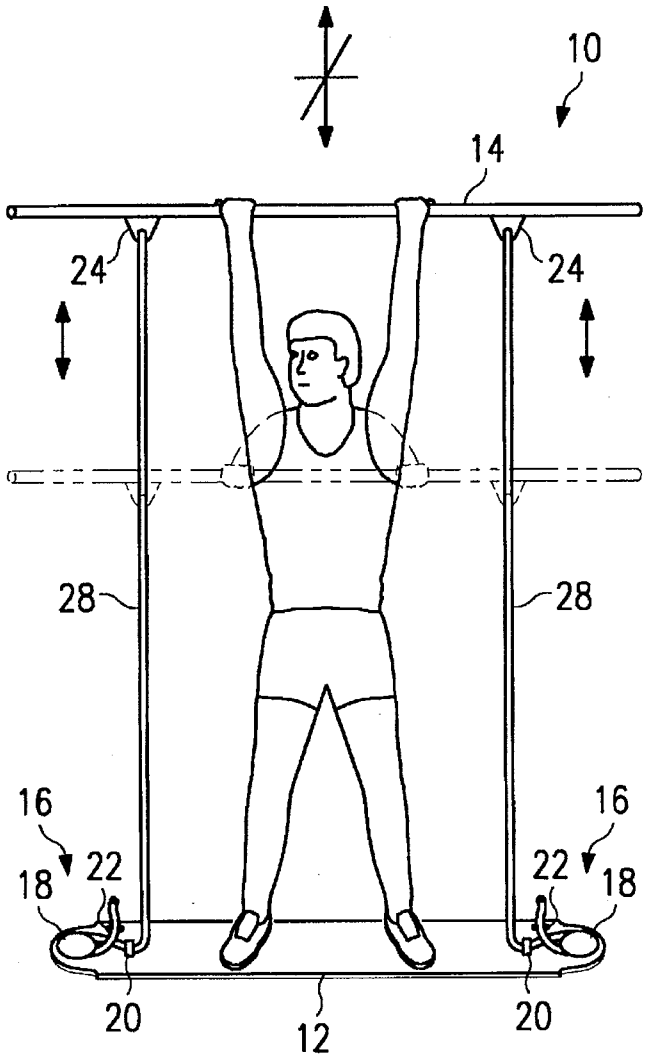
FIG. 4 illustrates a military press exercise, using the back exercising apparatus of the present invention.

Prior to commencing the exercises shown in FIGS. 4–8, preliminary stretching and warm-up exercises should be performed. Referring to FIG. 4, a military press exercise, using back exercising apparatus 10, is shown. The user stands on the generally flat lower elongated rigid member 12, lifts and holds the upper elongated rigid member 14 overhead, then lowers the upper elongated rigid member 14 to the chest, and then raises it back overhead. This is repeated for a desired number of repetitions, such as twelve (12) repetitions. The military press of FIG. 4 provides vertical compression of the spine. Referring to FIG. 4*a*, a military press with a rotation of the spine, using back exercising apparatus 10, is performed. The upper elongated rigid member 14 is lifted overhead and the user then rotates his body ninety degrees (90°) to the right. The desired number of rotations to the right, such as twelve (12) repetitions, are performed on the right side. The user then rotates his body 180° to the left side and the desired number of rotations to the left, such as twelve (12) rotations, are performed on the left side. The military press with rotation of FIG. 4*a* provides both vertical compression and rotation of the spine.

Figure 5:
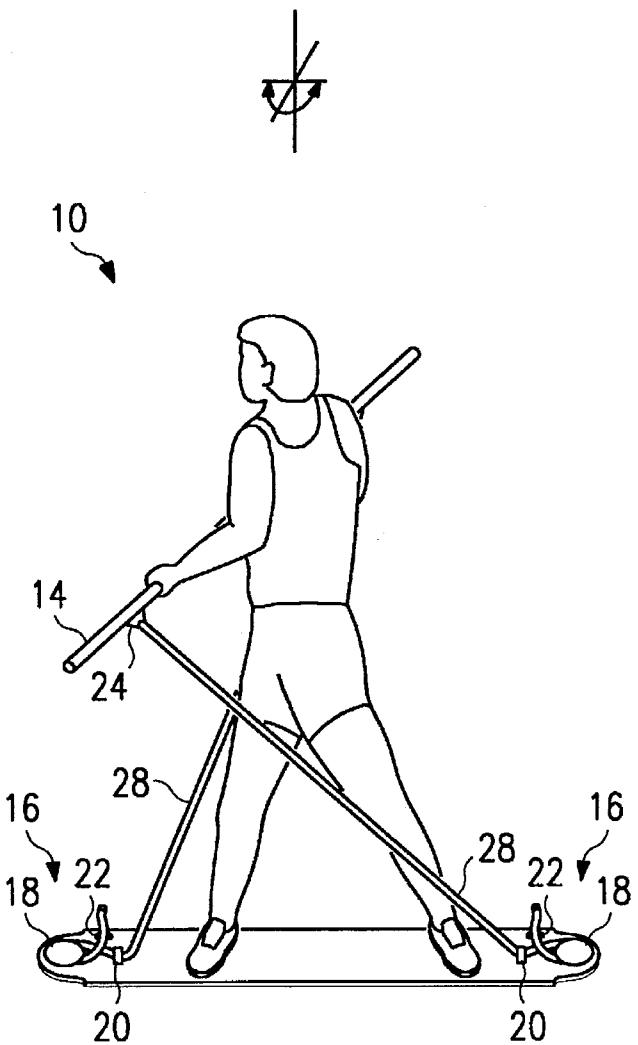
FIG. 5 illustrates a shoulder twist exercise, using the back exercising apparatus of the present invention.

Referring to FIG. 5, a shoulder twist exercise, using back exercising apparatus 10, is shown. Standing on the lower elongated rigid member 12, the user lifts the upper elongated rigid member 14 and then rotates the torso 90° first to the right and then to the left. This exercise is repeated for a desired number of repetitions, such as five (5) repetitions. The shoulder twist exercise provides both vertical compression and rotation of the spine.

Figure 6:
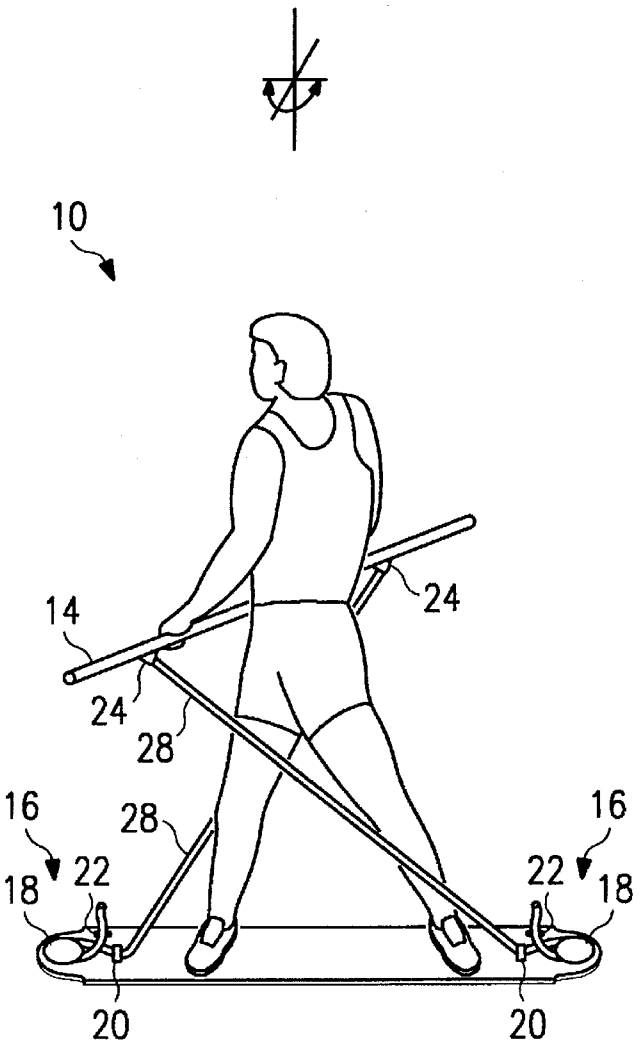
FIG. 6 illustrates a waist exercise, using the back exercising apparatus of the present invention.

Referring to FIG. 6, a waist twist exercise, using back exercising apparatus 10, is shown. The user stands on the lower elongated rigid member 12 and raises the upper elongated rigid member 14 to stomach level. The user then rotates the torso 90° first to the right then 90° to the left to complete a repetition. This exercise is repeated for a desired number of repetitions, such as five (5) repetitions. The waist twist exercise provides both vertical compression and rotation of the spine.

Figure 7:
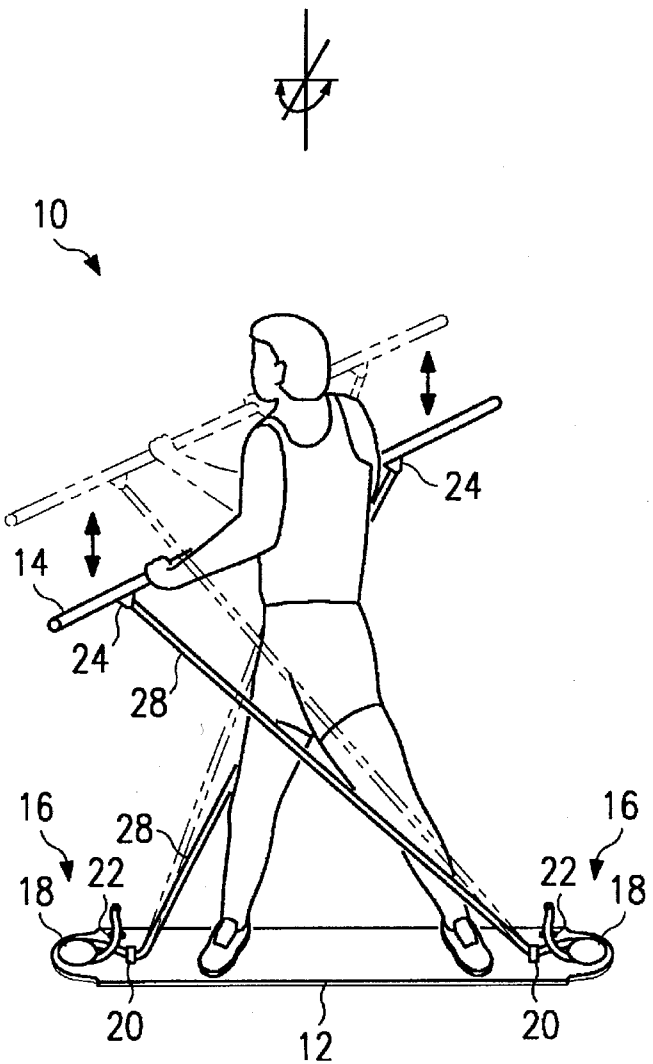
FIG. 7 illustrates a side curl exercise, using the back exercising apparatus of the present invention.

Referring to FIG. 7, a side curl exercise, using back exercising apparatus 10, is shown. The user stands on the lower elongated rigid member 12, holds the upper elongated rigid member 14 as if to perform arm curls, establishes tension in the adjustable resilient elastic members 28, and rotates 90° to the right. This rotated position is held while a number of curls exercising the biceps, such as five (5) curls, are performed. The user then rotates 180° to the left side and performs a number of curls on that side. The side curl exercise provides both vertical compression and rotation of the spine.

Figure 8:
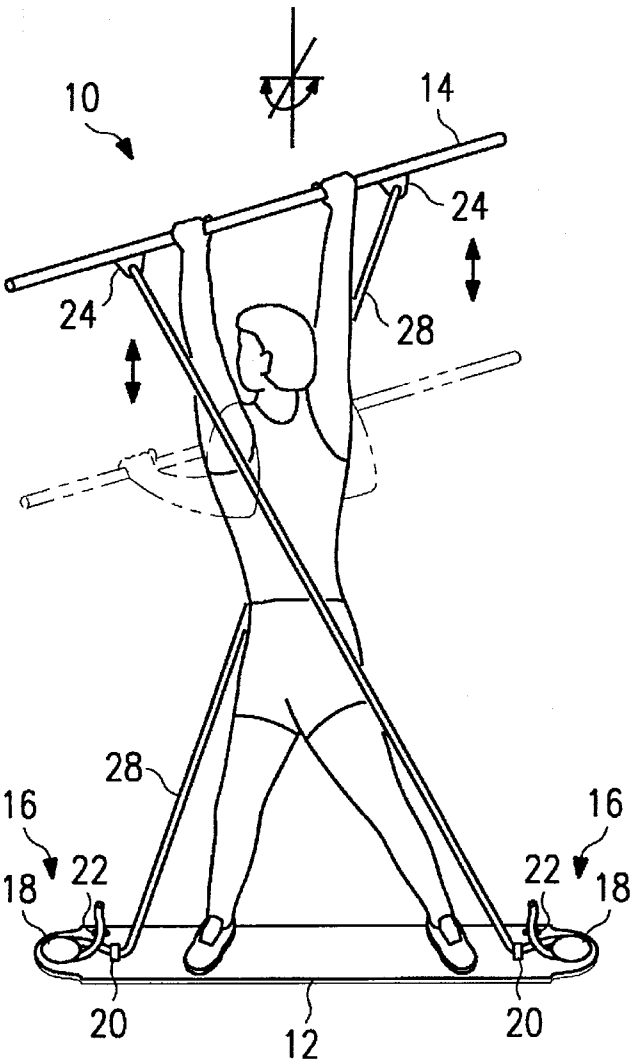
FIG. 8 illustrates a sideways military press exercise, using the back exercising apparatus of the present invention.

Referring to FIG. 8, a sideways military press exercise, using back exercising apparatus 10, is shown. The user stands on the lower elongated rigid member 12 and raises the upper elongated rigid member 14 overhead. The user then turns 90° to the right. In this position, the user performs the desired number of repetitions, such as five (5) repetitions, of the military press exercise shown and described in FIG. 4. The user then rotates 180° to the left and repeats the sideways military press exercise for the desired number of repetitions.

The exercises and exercise device of the present invention provide traction of the spine through compression of the spine and, alternately, compression and rotation of the spine simultaneously. The gravitational effect of mass, such as weights and bar bells, provides compression of the spine. Simultaneous rotation and compression of the spine is provided by the position of the user during the exercises described above. The muscles of the back are particularly suited for rotational exercises. For instance, the spinal muscles which include intercostal muscles between ribs are exercised by rotational movement of the user. The present invention combines the benefits of resistance weights and rotational exercises at the same time to strengthen the spine to relieve lower back pain. Thus muscles of the spine which have become weakened from disuse or improper posture may be conditioned and strengthened.

The present invention exercises muscles in proximity to painful areas in the back, so as to decompress the vertebrae of the spinal column and thus provide relief for overworked, agonistic muscles such as sore ligaments, muscles or tendons that join the bones of the spinal column together. Muscles of the spine that are in proximity to such painful areas are isolated and exercised. In the process of strengthening these muscles, the fibers of the muscles tighten and shorten, having the effect of decompressing or pulling the vertebrae back into a more balanced relationship. If there is a pinched nerve in the proximity to a particular vertebrae, then the pressure on this nerve is relieved by the movement of the vertebrae, thereby relieving back pain. As previously discussed, these muscles may be exercised both rotationally and longitudinally (vertically). The decompression of the vertebrae occurs after the exercises of FIGS. 4–8, which provide vertical compression and rotation of the spine, have been completed.

A further advantage of the present invention is that the exercise device is very small, portable and easily adapted to home use. It is also relatively inexpensive to make and purchase.

While the invention has been particularly shown and described with reference to a preferred embodiment, it will be understood by those skilled in the art that various changes in form and detail may be made therein without departing from the spirit and scope of the invention.

What is claimed is:

1. A back exercising apparatus, comprising:

(a) a generally flat lower elongated rigid member having a first end and a second end;

(b) an upper elongated rigid member having a first end and a second end;

(c) a first adjustable resilient elastic member and a second adjustable resilient elastic member, wherein the first adjustable resilient elastic member has a first end and a second end and the second adjustable resilient elastic member has a first end and a second end;

(d) means for attaching the first end of the first adjustable resilient elastic member to the first end of the upper elongated rigid member;

(e) means for attaching the first end of the second adjustable resilient elastic member to the second end of the upper elongated rigid member;

(f) a first retention structure mounted on the first end of the lower elongated rigid member for attaching the second end of the first adjustable resilient elastic member to the first end of the generally flat lower elongated rigid member, wherein the first retention structure is a windlass retention structure; and (g) a second retention structure mounted on the second end of the lower elongated rigid member for attaching the second end of the second adjustable resilient elastic member to the second end of the generally flat lower elongated rigid member, wherein the second retention structure is a windlass retention structure.

2. The apparatus of claim 1, wherein a first mass is attached to the first end of the upper elongated rigid member and a second mass is attached to the second end of the upper elongated rigid member.

3. The apparatus of claim 2, wherein the first mass may be removed from the first end of the upper elongated rigid member and the second mass may be removed from the second end of the upper elongated rigid member.

4. The apparatus of claim 1, wherein the first windlass retention structure comprises a first spool, a first guide member, and a first retention member for frictionally attaching the second end of the first adjustable resilient elastic member to the first end of the generally flat lower elongated rigid member, and the second windlass retention structure comprises a second spool, a second guide member, and a second retention member for frictionally attaching the second end of the second adjustable resilient elastic member to the second end of the generally flat lower elongated rigid member.

5. The apparatus of claim 1, wherein the means for fastening the first end of the first adjustable resilient elastic member to the first end of the upper elongated rigid member is a first connection member through which the first adjustable resilient elastic member may pass and be secured with a knot of the first adjustable resilient elastic member, and wherein the means for fastening the first end of the second adjustable resilient elastic member to the second end of the upper elongated rigid member is a second connection member through which the second adjustable resilient elastic member may pass and be secured with a knot of the second adjustable resilient elastic member.

6. The apparatus of claim 1, wherein the means for fastening the first end of the first adjustable resilient elastic member to the first end of the upper elongated rigid member is a first connection member through which the first adjustable resilient elastic member may pass and be secured with a first velcro material, and wherein the means for fastening the first end of the second adjustable resilient elastic member to the second end of the upper elongated rigid member is a second connection member through which the second adjustable resilient elastic member may pass and be secured with a second velcro material.

7. A back exercising apparatus, comprising:

(a) a generally flat lower elongated rigid member having a first end and a second end;

(b) an upper elongated rigid member having a first end and a second end;

(c) a first mass attached to the first end of the upper elongated rigid member;

(d) a second mass attached to the second end of the upper elongated rigid member;

(e) a first adjustable resilient elastic member and a second adjustable resilient elastic member each having a first end and a second end;

(f) means for attaching the first end of the first adjustable resilient elastic member to the first end of the upper elongated rigid member;

(g) means for attaching the first end of the second adjustable resilient elastic member to the second end of the upper elongated rigid member;

(h) means, connected to the first end of the lower elongated rigid member, for attaching the second end of the first adjustable resilient elastic member to the first end of the lower elongated rigid member, wherein the means for attaching the second end of the first adjustable resilient elastic member to the first end of the lower elongated rigid member is a windlass retention structure; and (i) means, connected to the second end of the lower elongated rigid member, for attaching the second end of the second adjustable resilient elastic member to the second end of the lower elongated rigid member, wherein the means for attaching the second end of the second adjustable resilient elastic member to the second end of the lower elongated rigid member is a windlass retention structure.

8. The apparatus of claim 7, wherein the means for attaching the first end of the first adjustable resilient elastic member to the first end of the upper elongated rigid member is a first connection member through which the first adjustable resilient elastic member may pass and be secured with a knot of the first adjustable resilient elastic member, and wherein the means for attaching the first end of the second adjustable resilient elastic member to the second end of the upper elongated rigid member is a second connection member through which the second adjustable resilient elastic member may pass and be secured with a knot of the second adjustable resilient elastic member.

9. The apparatus of claim 7, wherein the means for attaching the first end of the first adjustable resilient elastic member to the first end of the upper elongated rigid member is a first connection member through which the first adjustable resilient elastic member may pass and be secured with a first velcro material, and wherein the means for attaching the first end of the second adjustable resilient elastic member to the second end of the upper elongated rigid member is a second connection member through which the second adjustable resilient elastic member may pass and be secured with a second velcro material.

10. The apparatus of claim 7, wherein the first windlass retention structure comprises a first spool, a first guide member, and a first retention member for frictionally attaching the second end of the first adjustable resilient elastic member to the first end of the generally flat lower elongated rigid member, and the second windlass retention structure comprises a second spool, a second guide member, and a second retention member for frictionally attaching the second end of the second adjustable resilient elastic member to the second end of the generally flat lower elongated rigid member.

11. The apparatus of claim 7, wherein the first mass may be removed from the first end of the upper elongated rigid member and the second mass may be removed from the second end of the upper elongated rigid member.

* * * * *